US007992735B2

(12) United States Patent
Bullard et al.

(10) Patent No.: US 7,992,735 B2
(45) Date of Patent: Aug. 9, 2011

(54) APPARATUS AND METHOD FOR THE SEPARATE STORAGE AND MIXING OF SUBSTANCES

(75) Inventors: Brian L. Bullard, Elk Grove, CA (US); Jon Hull, Rancho Santa Margarita, CA (US)

(73) Assignee: Brian L. Bullard, Elk Grove, CA (US)

( * ) Notice: Subject to any disclaimer, the term of this patent is extended or adjusted under 35 U.S.C. 154(b) by 548 days.

(21) Appl. No.: 12/134,161

(22) Filed: Jun. 5, 2008

(65) Prior Publication Data

US 2009/0301904 A1 Dec. 10, 2009

(51) Int. Cl.
*B65D 25/08* (2006.01)

(52) U.S. Cl. ..... 215/11.1; 206/221

(58) Field of Classification Search ..... 215/11.1; 206/221; 126/263.08; 222/83
See application file for complete search history.

(56) References Cited

U.S. PATENT DOCUMENTS

| | | | | | |
|---|---|---|---|---|---|
| 2,786,769 | A | * | 3/1957 | Greenspan | 426/117 |
| 2,793,776 | A | * | 5/1957 | Lipari | 206/221 |
| 3,156,369 | A | | 11/1964 | Bowes et al. | |
| 3,355,047 | A | * | 11/1967 | De Sole | 215/11.1 |
| 3,613,955 | A | | 10/1971 | Wetherell | |
| 4,024,952 | A | | 5/1977 | Leitz | |
| 4,386,696 | A | | 6/1983 | Goncalves | |
| 4,610,374 | A | | 9/1986 | Buehler | |
| 4,651,899 | A | | 3/1987 | Pauls et al. | |
| 4,930,645 | A | * | 6/1990 | Warehime | 215/11.1 |
| 5,186,323 | A | * | 2/1993 | Pfleger | 206/221 |
| 5,275,298 | A | | 1/1994 | Holley, Jr. et al. | |
| 5,295,597 | A | | 3/1994 | Green | |
| 5,353,964 | A | | 10/1994 | Liu et al. | |
| 5,419,445 | A | | 5/1995 | Kaesemeyer | |
| 5,467,877 | A | * | 11/1995 | Smith | 215/11.1 |
| 5,540,341 | A | | 7/1996 | Holley et al. | |
| 5,542,922 | A | | 8/1996 | Petterson et al. | |
| 5,593,028 | A | | 1/1997 | Haber et al. | |
| 5,634,714 | A | | 6/1997 | Guild | |
| 5,692,644 | A | | 12/1997 | Gueret | |
| 5,772,017 | A | | 6/1998 | Kang | |
| 5,794,802 | A | | 8/1998 | Caola | |
| 6,079,405 | A | | 6/2000 | Justo | |
| 6,152,296 | A | * | 11/2000 | Shih | 206/222 |
| 6,386,872 | B1 | | 5/2002 | Mukasa et al. | |
| 6,474,861 | B1 | | 11/2002 | De Laforcade | |

(Continued)

OTHER PUBLICATIONS

International Search Report and Written Opinion, dated Jan. 18, 2010, from Application No. PCT/US2009/046129.

(Continued)

*Primary Examiner* — Anthony Stashick
*Assistant Examiner* — Cynthia F Collado
(74) *Attorney, Agent, or Firm* — Fitch Even Tabin & Flannery

(57) ABSTRACT

A storage and mixing device has an outer container and an inner container. Mounted at one end of the inner container is a first cap that rotates open and closed via a hinge. When the first cap is opened, the contents of the inner and outer containers are allowed to mix together. The other end of the inner container has an opening that is enclosed by a second cap operable to actuate a rod. When actuated, the rod pushes against the first cap thereby opening it and permitting the contents of the inner and outer containers to mix together.

34 Claims, 7 Drawing Sheets

U.S. PATENT DOCUMENTS

| | | | | |
|---|---|---|---|---|
| 6,655,525 | B2 | 12/2003 | Song | |
| 6,854,595 | B2 | 2/2005 | Kiser | |
| 6,920,991 | B2 | 7/2005 | Holley | |
| 6,926,138 | B1 | 8/2005 | Basham et al. | |
| 7,055,684 | B2 | 6/2006 | Anderson | |
| 7,635,012 | B2 * | 12/2009 | Johns et al. | 141/322 |
| 2004/0149768 | A1 | 8/2004 | Scoville | |
| 2006/0113201 | A1 | 6/2006 | Micic et al. | |
| 2007/0017890 | A1 | 1/2007 | Al-Jadh | |
| 2009/0301905 | A1 | 12/2009 | Bullard | |

OTHER PUBLICATIONS

European Patent Publication No. 0392609B1, published Mar. 30, 1994.

International Application Publication No. WO97/16101, published May 9, 1997.

International Application Publication No. WO09/149184A2, published Dec. 10, 2009, for Application No. PCT/US09/046129 filed Jun. 3, 2009.

* cited by examiner

APPARATUS AND METHOD FOR THE SEPARATE STORAGE AND MIXING OF SUBSTANCES

1. FIELD OF INVENTION

This relates to a container that can separately store at least two substances, and when desired, mix these substances together.

2. BACKGROUND

When two substances, such as a powder and a liquid for example, are mixed together and stored in a container for a relatively short period of time, it sometimes happens that their properties are such that the mixture degrades or is otherwise rendered unusable for its intended purpose. One example involves dry powder baby formula that is designed to be mixed with water. When separately stored, the powder formula and the water can be kept in a usable condition for a relatively long period of time. When mixed together however, the resulting solution spoils rather quickly and is no longer usable. There is a need therefore for a container which is capable of separately storing two or more substances and of mixing them when desired.

Various known containers and devices were designed to achieve this purpose. However, many of them have disadvantages including high manufacturing costs, complicated structures, one-time use capability only, unreliable operation, difficulty in achieving good mixing results, inconvenient or awkward actuation for causing the substances to mix together, and/or difficulty in cleaning and re-assembly, etc. There is therefore a need for improved devices and methods for storing and mixing substances in order to overcome some or all of the foregoing disadvantages.

SUMMARY OF THE ILLUSTRATED EMBODIMENTS

Embodiments of the invention include a device having an outer container and an inner container. Mounted at one end of the inner container is a first cap that rotates open and closed via a hinge. When the first cap is opened, the contents of the inner and outer containers are allowed to mix together. The other end of the inner container has an opening that is enclosed by a second cap operable to actuate a rod. When actuated, the rod pushes against the first cap thereby opening it and permitting the contents of the inner and outer containers to mix together.

In an alternative embodiment of the invention, a device comprises a first container defining a first chamber for containing the first substance and a second container defining a second chamber for containing the second substance. A first cap is configured for movement from a closed or sealing position to an open position and for movement from the open position to the sealing position. The first cap is coupled to either the first container or the second container when the first cap is both in the sealing position and in the open position.

The first and second chambers are in a first state when the first cap is in the sealing position, and they are in a second state when the first cap is in the open position. The first state is the first and second chambers being sealed from one another, whereas the second state is the first and second chambers being in communication with one another. An operating member is configured to move the first cap from the sealing position to the open position upon actuation of the operating member. The first container, the second container and the first cap are configured so that the first and second chambers can alternate a plurality of times between the first state and the second state during normal usage.

In yet another alternative embodiment, a baby bottle for use with a nipple is provided. A first container defines a proximate first container opening, a distal first container opening, and a first chamber. The proximate first container opening is configured to be closed by the nipple. A second container defines a proximate second container opening, a distal second container opening, and a second chamber. A first cap is pivotally mounted on the second container and has an open position and a sealing position. The first cap is configured to cover the proximate second container opening when the first cap is in the sealing position. A second cap is configured to enclose the distal second container opening. At least a portion of the second cap is movable between a cap first position and a cap second position.

A rod configured for coupling to the second cap and for extending in a direction toward the proximate second container opening when the second cap encloses the distal second container opening. The rod is further configured to move between a rod first position and a rod second position in response to movement of the at least a portion of the second cap between the cap first position and the cap second position. At least a portion of the second container is configured to be disposed within the first chamber so that the second chamber is in communication with the first chamber via the proximate second container opening when the first cap is in the open position. The rod, the first cap and the second cap are configured so that the first cap is moved from the closed position to the open position in response to movement of the rod from the rod first position to the rod second position.

In yet another embodiment, a device for holding a first substance and a second substance is provided. A first container defines a first chamber for containing the first substance. A second container defines a second chamber for containing the second substance. The first and second containers are configured so that at least a portion of the second container can be inserted into the first container. The second container defines a proximate second container opening leading into the second chamber. The second chamber is configured to be in communication with the first chamber via the proximate second container opening when the second container is inserted into the first container. The device further includes means for alternately closing and opening the proximate second container opening a plurality of times, wherein the first and second chambers are not in communication with one another each time that the second container opening is closed and wherein the first and second chambers are in communication with one another each time that the proximate second container opening is opened.

In yet another embodiment, a method of mixing a first substance and a second substance is disclosed. A first container and a second container are provided wherein the first container defines a first chamber containing the first substance and the second container defines a second chamber containing the second substance. An operating member, such as for example a rod, is actuated. A first cap is moved from a sealing position to an open position in response to the actuation of the operating member. The first cap is coupled to either the first container or the second container. However the first cap remains coupled to either the first or second container when the first cap is both in the sealing and the open positions. If the first cap is in the sealing position, it is disposed between the first chamber and the second chamber. On the other hand if the first cap is in the open position, the first chamber is in communication with the second chamber. The first substance is then mixed with the second substance.

In yet another embodiment a method of mixing a first substance and a second substance is disclosed. At least a portion of a second container is inserted into a first container. The second container is configured for use with a first cap and a second cap. The second substance is placed into the second container through a distal second container opening defined by the second container. The distal second container opening is enclosed with the second cap. The first substance is placed into the first container through a proximate first container opening defined by the first container. The proximate first container opening is enclosed. The second cap is pushed thereby actuating an operating member and opening the first cap.

There are additional aspects to the present inventions. It should therefore be understood that the preceding is merely a brief summary of some embodiments and aspects of the present inventions. Additional embodiments and aspects are referenced below. It should further be understood that numerous changes to the disclosed embodiments can be made without departing from the spirit or scope of the inventions. The preceding summary therefore is not meant to limit the scope of the inventions. Rather, the scope of the inventions is to be determined by appended claims and their equivalents.

BRIEF DESCRIPTION OF THE DRAWINGS

These and/or other aspects and advantages of the present invention will become apparent and more readily appreciated from the following description of certain embodiments, taken in conjunction with the accompanying drawings of which.

DETAILED DESCRIPTION

Figure 1:
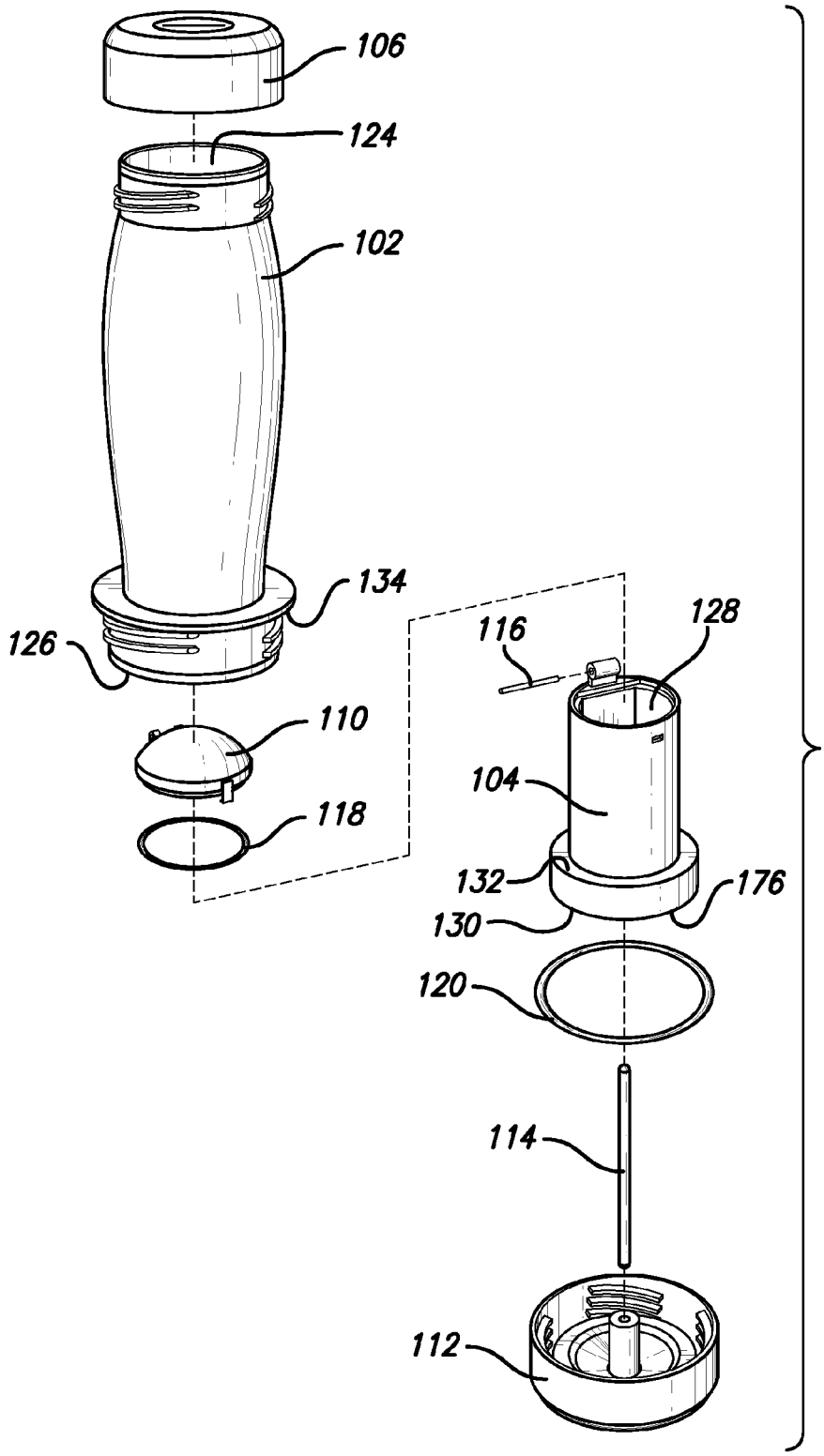
FIG. 1 is an exploded parts diagram of a baby bottle in accordance with one embodiment of the invention.

The following description is of the best mode presently contemplated for carrying out the invention. Reference will be made in detail to embodiments of the present invention, examples of which are illustrated in the accompanying drawings, wherein like reference numerals refer to like elements throughout. It is understood that other embodiments may be used and structural and operational changes may be made without departing from the scope of the present invention.

Figure 2:
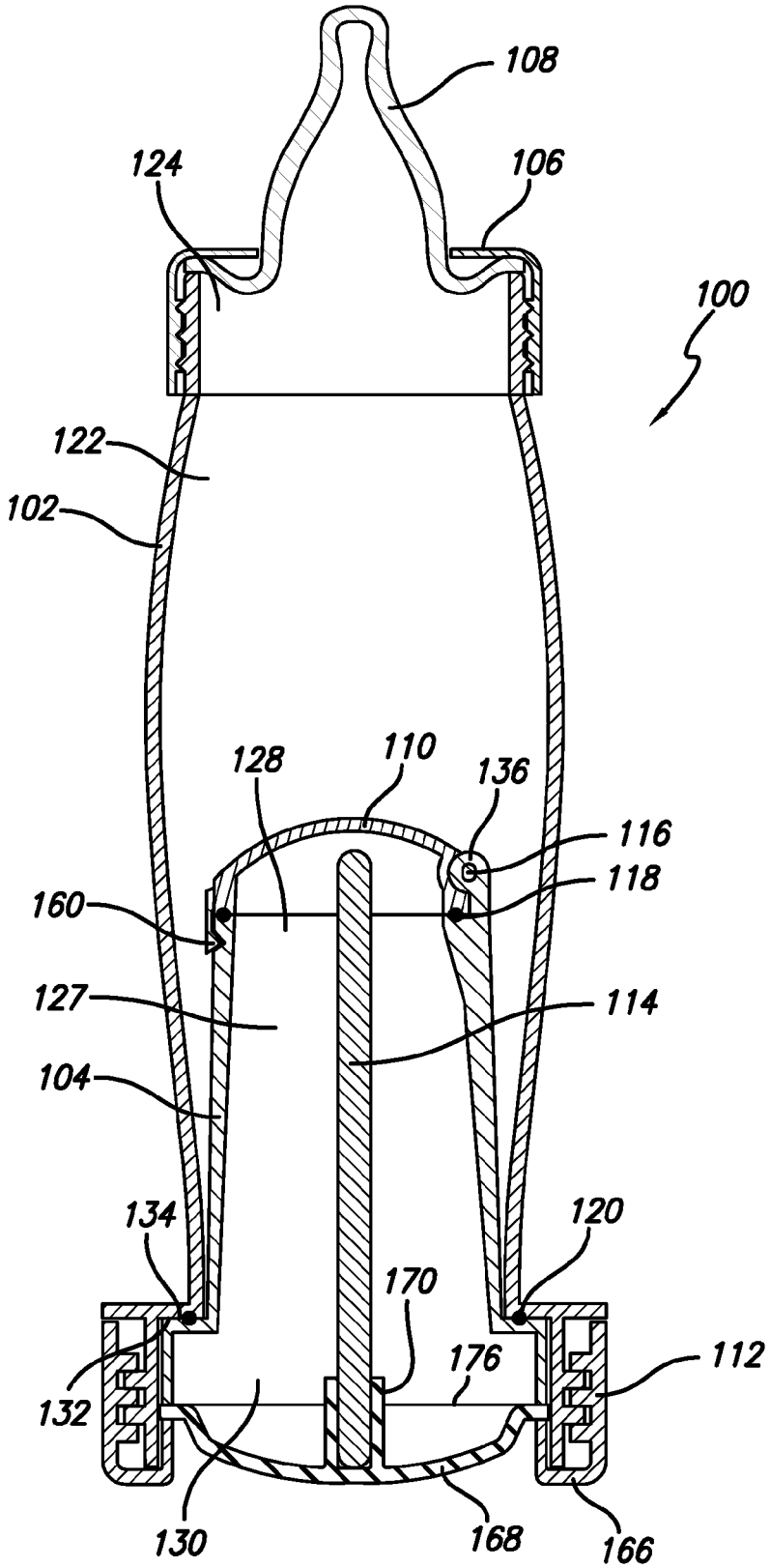
FIG. 2 is a cross section view of the assembled baby bottle of FIG. 1.

Referring to FIGS. 1 and 2, there is shown a baby bottle 100 that includes a first (or outer) container 102 for holding a first substance (not shown), a second (or inner) container 104 for holding a second substance (not shown), a cap ring 106, a nipple 108, a first cap 110, a second cap 112, an operating member or rod 114, a hinge pin 116, an upper O-ring 118 and a lower O-ring 120.

The first container 102 is generally elongated in shape and defines a first chamber 122, a proximate first container opening 124 at one end of the first container 102 and leading into the first chamber 122, and a distal first container opening 126 at the opposite end of the first container 102 and also leading into the first chamber 122. The nipple 108 is configured to cover the proximate first container opening 124, and the cap ring 106 is configured for removable, threaded engagement with the first container 102 so that it secures the nipple 108 in place with a fluid-tight seal.

The second container 104 also is generally elongated in shape and defines a second chamber 127, a proximate second container opening 128 at one end of the second container 104 and leading into the second chamber 127 and a distal second container opening 130 at the opposite end of the second container 104 and also leading into the second chamber 127. The first and second containers 102, 104 are removable from one another during normal usage by an end user and are configured to mate with one another in a generally coaxial relationship. That is, the second container 104 can be inserted through the distal first container opening 126 and can be disposed within the first chamber 122 so that the distal first container opening 126 is sealed closed by the second container 104. The sealing of the distal first container opening 126 is accomplished by a ledge 132 on the second container 104 that seats on a corresponding ledge 134 of the first container 102 with the lower O-ring 120 disposed between the ledges 132, 134 as best seen in FIG. 2.

Figure 5:
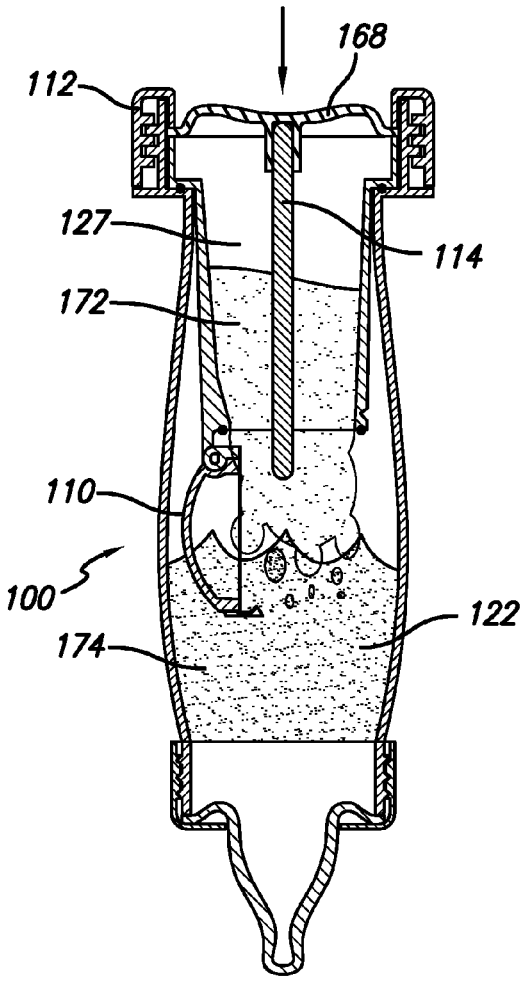
FIG. 5 is a cross section view of the baby bottle of FIG. 4 but inverted and with the second cap in a second position for allowing the two substances to mix with one another.

The first cap 110 is pivotally mounted on the second container 104 with a hinge 136 that is disposed at a location adjacent to the proximate second container opening 128. Thus the first cap 110 is configured so that it can rotate or move from a closed or sealing position to an open position as well as from the open position to the sealing position. When the first cap 110 is in the sealing position as shown in FIG. 2, it abuts the upper O-ring 118 and covers the proximate second container opening 128 so that the first and second chambers 122, 126 are in a first condition or state, i.e., they are sealed from one another thereby keeping the first and second substances separated from one another. On the other hand, when the first cap 110 is in the open position as shown in FIG. 5, the first and second chambers 122, 126 are in a second state, i.e., they are in communication with one another, thereby permitting the first and second substances to mix with one another. Moreover, this open position allows the proximate second container opening 128 to be fully uncovered thus exposing the full, radial cross-section area of the second chamber 127 to the first chamber 122 for optimum mixing of the substances.

Figure 10A:
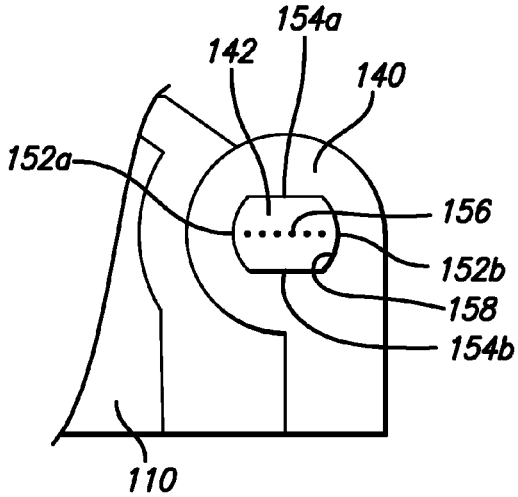
FIG. 10*a* is an enlarged view of a portion of FIG. 9 showing a portion of a hinge that is associated with the first cap.
Figure 10B:
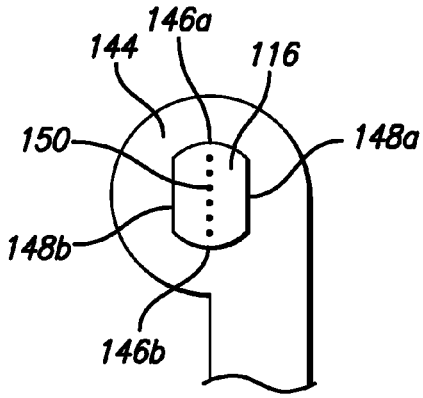
FIG. 10*b* is an enlarged view of a portion of FIG. 9 showing another portion of the hinge that is associated with the second container.
Figure 6:
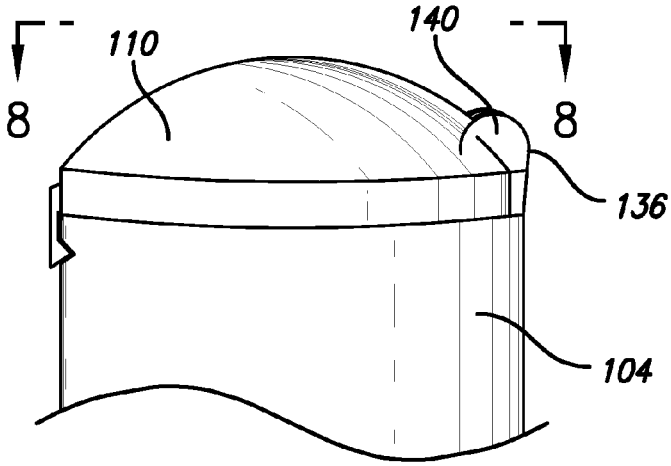
FIG. 6 is a perspective view of the first cap in the sealing position and an upper portion of the second container of the baby bottle of FIG. 2.
Figure 7:
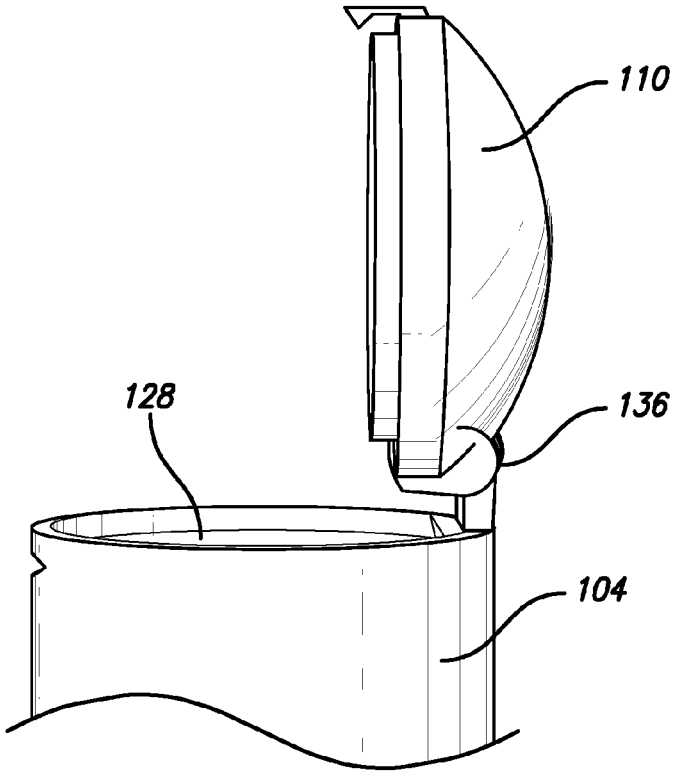
FIG. 7 is a perspective view of the first cap in the open position and an upper portion of the second container of the baby bottle of FIG. 2.
Figure 8:
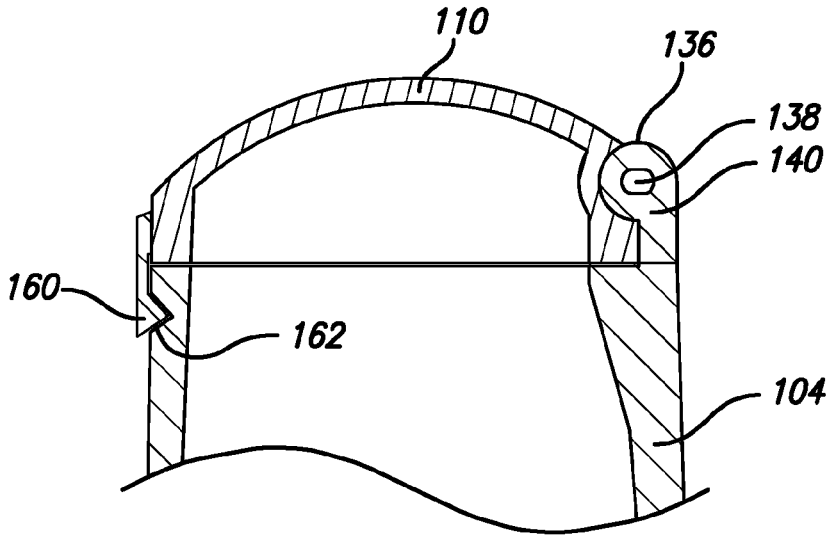
FIG. 8 is a cross section view of the first cap and the upper portion of the second container along lines 8-8 of FIG. 6.
Figure 9:
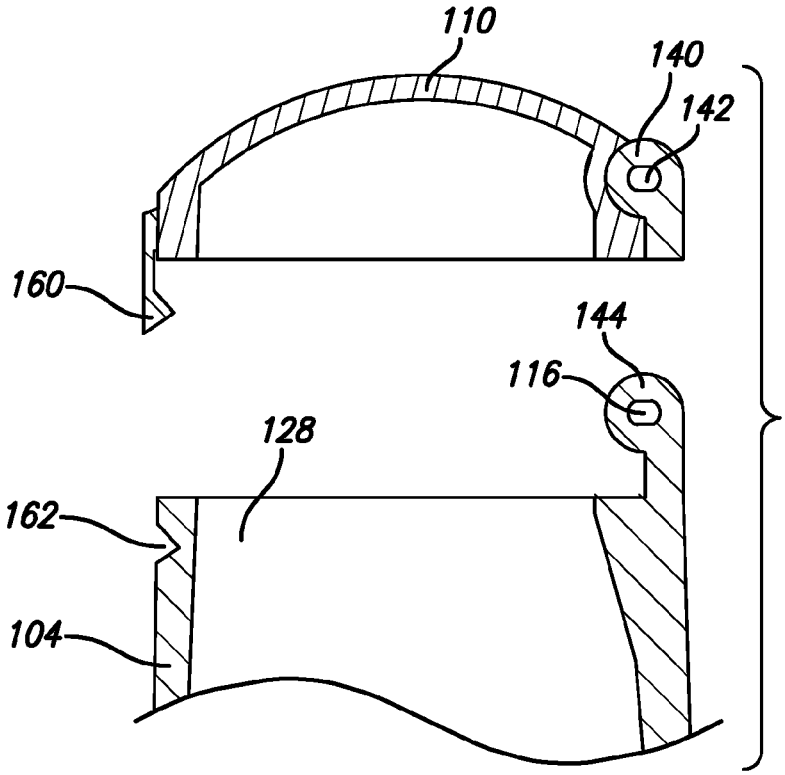
FIG. 9 is a cross section view of the components of FIG. 8 but with the first cap detached from the second container.

FIGS. 6 and 7 are perspective views of the hinge 136, the first cap 110 and an upper portion of the second container 104 when the first cap 110 is in the sealed and open positions, respectively. FIG. 8 shows a cross section view of the hinge 136, the first cap 110 and the upper portion of the second container 104 along the lines 8-8 of FIG. 6. FIG. 9 shows a cross section view of these same components of FIG. 8, but with the first cap 110 detached from the second container 104 for clarity of illustration. FIGS. 10*a* and 10*b* are enlarged views of portions of FIG. 9, wherein FIG. 10*a* shows a portion of the hinge 136 that is associated with the first cap 110, and wherein FIG. 10*b* shows another portion of the hinge 136 that is associated with the second container 104.

Referring now to these FIGS. 6 to 10*a* and 10*b*, the hinge 136 comprises the pin 116 and a hinge member 140. The hinge member 140 is part of the first cap 110 and defines a hinge cavity 142 configured to receive the pin 116. The pin 116 is fixedly secured into a pin housing 144 so as to inhibit rotation of the pin 116. The pin housing 144 is integral with the second container 104 and extends upwardly from and above the proximate second container opening 128. Although FIG. 10*a* shows one hinge member 140 and hinge cavity 142, the first cap 110 in fact includes two hinge members and hinge cavities disposed in a spaced-apart relationship so that the pin 116 is disposed between them such that each hinge cavity receives one or the other end of the pin 116.

As best seen in FIG. 10*b*, the pin cross section geometry defines a shape that is generally elongated, has two generally arcuate-shaped sides 146*a*, 146*b* connected by two generally linearly-shaped sides 148*a*, 148*b*, and includes an imaginary pin cross section longitudinal axis 150. As best seen in FIG. 10*a*, the cavity cross section geometry similarly defines a shape that is generally elongated, has two generally arcuate-shaped sides 152*a*, 152*b* connected by two generally linearly-shaped sides 154*a*, 154*b*, and includes an imaginary cavity cross section longitudinal axis 156.

The hinge cavity 142 has a cavity wall 158 and is configured to permit relative rotation between the cavity wall 158 and the pin 116 when the first cap 110 moves between the sealing position and the open position. The pin 116 and hinge cavity 142 are configured so that the imaginary pin cross section longitudinal axis 150 is oriented generally normal to the imaginary cavity cross section longitudinal axis 156 if the first cap 110 is in the sealed position as shown in FIGS. 9, 10*a* and 10*b*. On the other hand, the imaginary pin cross section longitudinal axis 150 is generally aligned with the imaginary cavity cross section longitudinal axis 156 if the first cap 110 is in the open position. It thus can be seen that when the first cap 110 is in the open position either no stress or a relatively low stress is exerted between the pin 116 and the cavity wall 158, because the pin cross section and the cavity cross section geometries are generally aligned with one another. On the other hand when the first cap 110 is in the sealing position, the pin and cavity cross sections are out of alignment as shown in FIGS. 10*a* and 10*b* so that a relatively larger stress is exerted between the pin 116 and the cavity wall 158.

The cavity wall 158 and the pin 116 each is constructed of a resilient material, such as plastic, so as to permit an out-of-alignment, relative movement and orientation. Nevertheless, the pin 116 is constructed of a material having a greater hardness (although still resilient) than that of the hinge member 140 so as to improve the hinge 136 operation. (In alternative embodiments, this can be reversed so that the hinge member 140 is constructed of a material having a greater hardness than that of the pin 116, or alternatively still, they can be constructed of materials having generally the same hardness.) Thus when the first cap 110 moves from the sealing to the open position, the first cap 110 will have a tendency to snap into place and remain in a fully-opened position due to the reduced stress (or no stress) between the pin 116 and the cavity wall 158. However when the baby bottle 100 is disassembled and a user wants to close the first cap 110, the user can move the first cap 110 back to the sealing or closed position by rotating it about the hinge 136 with enough force to overcome the stress between the pin 116 and cavity wall 158. When placed into the sealed position, a latch 160 on the first cap 110 engages an indentation 162 in the wall of the second container 104 thereby securing the first cap 110 in the sealing position, as best seen in FIGS. 6 and 8.

Although FIGS. 8 to 10*a* and 10*b* depict a hinge pin and cavity arrangement having a particular geometry and cross section, it will be appreciated that alternative embodiments of the invention include other configurations and geometries wherein a stress is placed between a pin and cavity wall if the first cap 110 is in the sealing position and wherein a lesser stress (or no stress) exists if the first cap 110 is in the open position.

While FIGS. 8 to 10*a* and 10*b* disclose a hinge for connecting the first cap 110 to the second container 104, alternative embodiments include other fastening devices which can be used to secure the first cap 110 to either the second container 104, the first container 102 or to other components of the baby bottle 100. These alternative embodiments allow the first cap 110 to move from a sealing position to an open position and from the open position to the sealing position, so that the two chambers can alternate a plurality of times between the two states, i.e., sealed from one another on the one hand, and in communication with one another on the other hand.

Referring again to FIG. 2, the second cap 112 is comprised of a ring-shaped, rigid member 166 defining an opening, a flexible wall 168 or diaphragm attached to the rigid member 166 and extending across the opening, and a sleeve 170 extending axially upward from the flexible wall 168. The rigid member 166 is configured for threaded engagement with the first container 102 near the distal first container opening 126. (In alternative embodiments, the rigid member 166 can be configured for a snap-fit engagement with the first container 102.) Thus when the second container 104 is disposed in the first container 102, the flexible wall 168 of the second cap 112 is pressed against a rim 176 of the second container 104 (that forms the distal second container opening 130) thereby enclosing and sealing the distal second container opening 130. The rod 114 is coupled to the flexible wall 168 by insertion of one end of the rod 114 into the sleeve 170. When inserted into the sleeve 170, the rod 114 extends axially in a direction toward the proximate second container opening 128.

Figure 4:
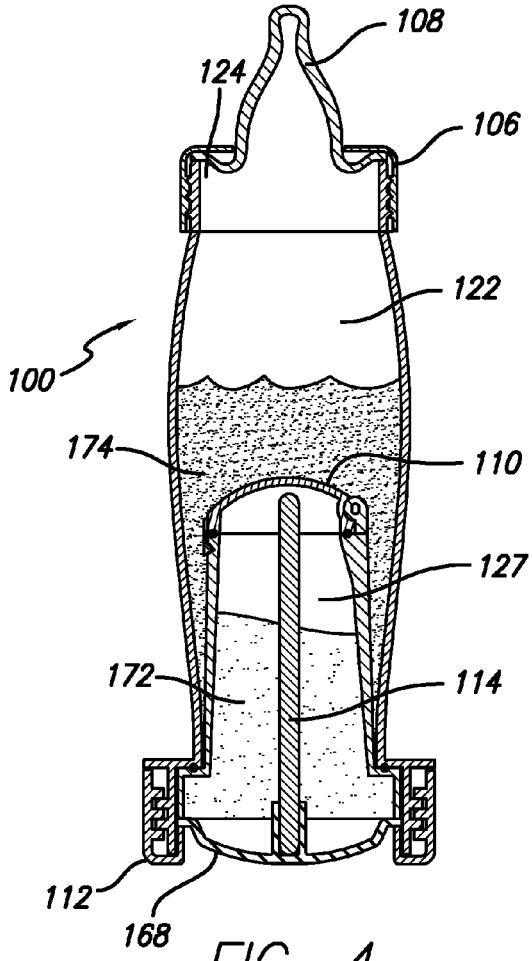
FIG. 4 is a cross section view of the baby bottle of FIG. 2 holding two substances that are separated from one another.

Thus it can be seen that when an external force is applied to the flexible wall 168 in a direction generally normal to it (such as by pushing the wall 168 with the thumb of a user in a single-handed operation), this causes the second cap 112 to move between a cap first position as shown in FIG. 4, wherein the flexible wall 168 is not depressed or deformed, to a cap second position as shown in FIG. 5, wherein the flexible wall 168 is depressed or deformed. This in turn moves or actuates the rod 114 in an axial direction from a rod first position as shown in FIG. 4 to a rod second position as shown in FIG. 5, thereby pushing the first cap 110 with enough force to overcome the holding force of the latch 160. The first cap 110 moves from the sealing position to the open position where it snaps into place (and remains in place) as a result of the reduced stress between the pin 116 and the cavity wall 158 as previously described.

It should be noted that the actuation of the rod 114 is by an axial movement of the second cap 112 resulting from a pushing force applied in a generally normal direction to the flexible wall 168, as shown by the arrow in FIG. 5, and that this axial movement has essentially no rotary component. Because there is essentially no rotary or twisting movement, the first cap 110 can be conveniently and easily opened by a user in a single-handed operation.

Thus it can be seen that the first cap 110, the hinge 136, the second cap 112 and the rod 114 comprise a means for alternately closing and opening the proximate second container opening 128 a plurality of times. During normal usage by an end user, each of the nipple 108, the cap ring 106, the first container 102, the second container 104, the second cap 112 and the rod 114 can be disassembled from one another for cleaning and can be re-assembled for repeated use. The baby bottle 100 therefore can be used and reused a plurality of times so that the first and second chambers 122, 126 are sealed from one another for separately holding and storing two substances, such as water and a powder formula, and so that the first and second chambers 122, 126 can be placed in communication with one another when the user desires to mix these two substances.

Although FIGS. 4 and 5 show a rod for use in opening the first cap, alternative embodiments include other operating members having other shapes, sizes and configurations for moving a cap from a sealing position to an open position upon actuation of the operating member by a user.

While FIG. 2 depicts a baby bottle, it should be appreciated that alternative embodiments of the invention include other devices and containers having other shapes and sizes and for use in separately storing at least two substances and for mixing these substances when desired. Moreover, alternative embodiments can be used for substances other than dry powder formula and water, and can include uses other than for feeding babies. These other embodiments can be for separately-stored substances that are either edible or inedible, where all of the substances are in the same form, i.e., solid, liquid or gaseous, or where the separately-stored substances are in different forms.

Figure 3:
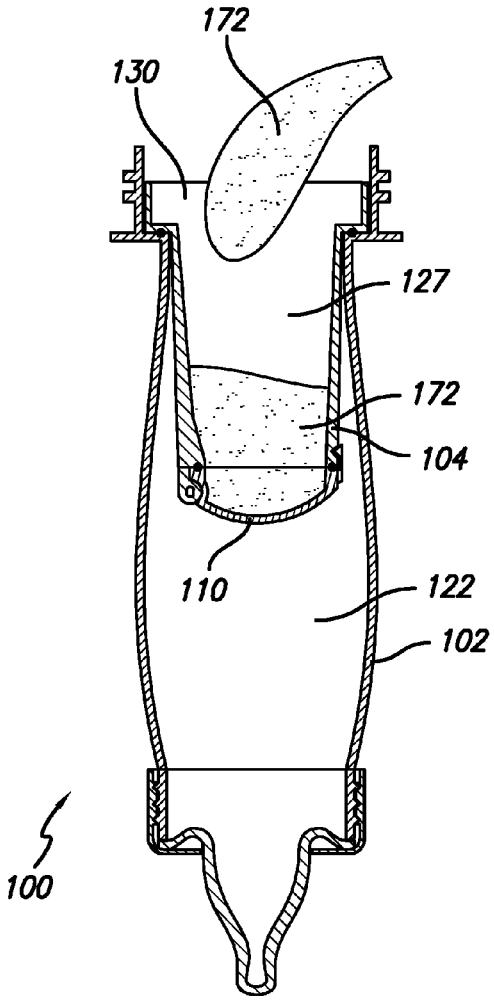
FIG. 3 is a cross section view of the baby bottle of FIG. 2 but inverted and with the second cap removed.

In operation, with the second cap 112 removed from the first container 102 and the baby bottle 100 inverted, a dry powder formula 172 is poured through the distal second container opening 130 into the second chamber 127 of the second container 104 as shown in FIG. 3. Then the second cap 112 is secured onto the first container 102 thus sealing shut the distal second container opening 130. The baby bottle 100 is restored to its upright position, the cap ring 106 and nipple 108 are removed, and water 174 is poured through the proximate first container opening 124 and into the first chamber 122 of the first container 102. The cap ring 106 and nipple 108 are then secured back onto the first container 102 thus enclosing the proximate first container opening 124. The dry powder formula 172 and the water 174 are now conveniently and separately contained within the baby bottle 100 for relatively long-term storage as shown in FIG. 4.

When a user desires to mix the water 174 and the dry powder formula 172, the baby bottle 100 is inverted, and the user pushes the flexible wall 168 of the second cap 112 in an easy, single-handed operation, as shown in FIG. 5. This actuates the rod 114 so that it moves axially in a direction toward the first cap 110 and so that it pushes the first cap 110 from the sealing position to the open position as is also shown in FIG. 5. With the first cap 110 in the open position, the proximate second container opening 128 is fully uncovered thus exposing the full, radial cross-section area of the second chamber 127 to the first chamber 122. This allows for a free and rapid flow of the dry powder formula 172 into the water 174 and provides for optimum mixing of these substances.

Figure 11:
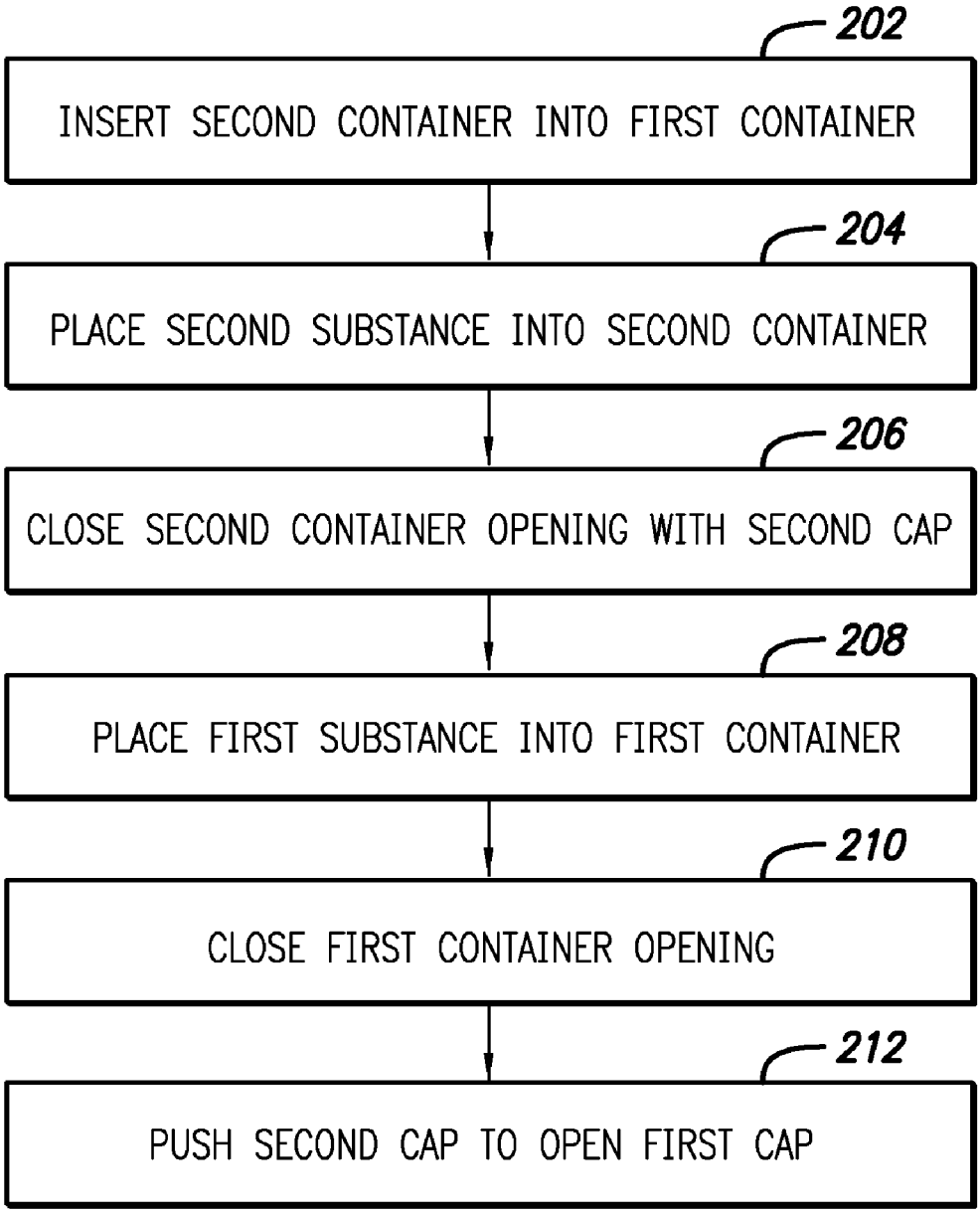
FIG. 11 is a simplified process flow diagram for a method of mixing a first substance and a second substance in accordance with another embodiment of the invention.

FIG. 11 is a simplified process flow diagram for a method of mixing a first substance and a second substance in accordance with another embodiment of the invention. A second container is inserted into a first container, wherein the second container is configured for use with a first cap and a second cap. (Step 202) The second substance is placed into the second container through a distal second container opening. (Step 204) The distal second container opening is closed with the second cap. (Step 206) The first substance is placed into the first container through a proximate first container opening. (Step 208) The proximate first container opening is sealed closed. (Step 210) When a user desires to mix the first and second substances, the second cap is pushed by the user thereby actuating an operating member which in turn opens the first cap. (Step 212). Once the first cap is opened, the chamber of the second container is in communication with the chamber of the first container, thus allowing the first and second substances to mix with one another.

In view of the above, it will be appreciated that embodiments of the invention overcome many of the long-standing problems in the art by providing a device having an outer container and an inner container. Mounted at one end of the inner container is a first cap that rotates open and closed via a hinge. When the first cap is opened, the contents of the inner and outer containers are allowed to mix together. The other end of the inner container has an opening that is enclosed by a second cap operable to actuate a rod. When actuated, the rod pushes against the first cap thereby opening it and permitting the contents of the inner and outer containers to mix together.

While the description above refers to particular embodiments of the present invention, it will be understood that many modifications may be made without departing from the spirit thereof. The claims are intended to cover such modifications as would fall within the true scope and spirit of the present invention. The presently disclosed embodiments are therefore to be considered in all respects as illustrative and not restrictive, the scope of the invention being indicated by the claims rather than the foregoing description, and all changes which come within the meaning and range of equivalency of the claims are therefore intended to be embraced therein.

What is claimed is:

1. A device for holding a first substance and a second substance, the device comprising:

a first container defining a first chamber for containing the first substance;

a second container defining a second chamber for containing the second substance;

a first cap configured for movement from a sealing position to an open position and for movement from the open position to the sealing position, wherein the first and second chambers are in a first state when the first cap is in the sealing position, wherein the first and second chambers are in a second state when the first cap is in the open position, wherein the first state is the first and second chambers being sealed from one another, and wherein the second state is the first and second chambers being in communication with one another; and an operating member configured to move the first cap from the sealing position to the open position upon actuation of the operating member, wherein the first cap is coupled to one of the first container and the second container when the first cap is both in the sealing position and in the open position.

2. The device of claim 1 wherein the first container, the second container and the first cap are configured so that the first and second chambers can alternate a plurality of times between the first state and the second state during normal usage.

3. The device of claim 1 wherein each of the first container and the second container is configured for disassembly and re-assembly a plurality of times during normal usage.

4. The device of claim 1 wherein the first container further defines a first container opening leading into the first chamber, and wherein the second container is configured to mate with the first container so that the first container opening is sealed closed.

5. The device of claim 4 wherein the first and second containers are in a generally coaxial relationship with at least a portion of the second container disposed within the first chamber when the second container is mated with the first container.

6. The device of claim 1 wherein the actuation of the operating member is by axial movement having no rotary component.

7. The device of claim 1 wherein the second container further defines a proximate second container opening leading into the second chamber and a distal second container opening leading into the second chamber, wherein the first cap is configured to cover the proximate second container opening when the first cap is in the sealing position, the device further comprising:

a second cap configured to enclose the distal second container opening, wherein at least a portion of the second cap is movable between a cap first position and a cap second position, and wherein the operating member is configured to be coupled to the second cap and to be actuated by the second cap when the at least a portion of the second cap moves from the cap first position to the cap second position.

8. The device of claim 7 wherein the second cap is comprised of a rigid member and a flexible wall, wherein the rigid member is configured to engage the first container and wherein the operating member is configured for coupling to the flexible wall.

9. The device of claim 7 wherein the second cap is comprised of a rigid member and a flexible wall, wherein the rigid member is configured to engage the first container, wherein the operating member is coupled to the flexible wall, and wherein the second cap is configured to move from the cap first position to the cap second position in response to an external force applied to the flexible wall in a direction generally normal to the flexible wall.

10. The device of claim 7 wherein the operating member is a rod, wherein the second cap further comprises a sleeve, and wherein the rod is configured to mate with the sleeve.

11. The device of claim 7 wherein each of the first container, the second container, and the second cap is configured for disassembly and re-assembly during normal usage and is configured so that the first and second chambers can alternate a plurality of times between the first state and the second state during normal usage.

12. The device of claim 1 wherein the first cap is pivotally connected to the one of the first container and the second container when the first cap is both in the sealing position and in the open position.

13. The device of claim 12 wherein the first cap is pivotally connected to the one of the first container and the second container with a hinge, wherein the hinge comprises a pin and a hinge member defining a hinge cavity configured to receive the pin.

14. The device of claim 13 wherein the pin is secured to inhibit rotation of the pin, wherein the pin has a pin cross section geometry and the hinge cavity has a cavity cross section geometry, wherein the hinge cavity has a cavity wall and is configured to permit relative rotation between the cavity wall and the pin when the first cap moves between the sealing position and the open position, and wherein the pin cross section geometry and the cavity cross section geometry are configured so that one of no stress and a first stress is exerted between the pin and the cavity wall if the first cap is in the open position, and so that a second stress is exerted between the pin and the cavity wall if the first cap is in the sealing position, wherein the second stress is greater than the first stress.

15. The device of claim 14 wherein the pin is constructed of a material having a first hardness and the hinge member is constructed of a material having a second hardness that is different than the first hardness.

16. The device of claim 14 wherein the pin cross section geometry and the cavity cross section geometry each define a shape that is generally elongated and has two generally arcuate-shaped sides connected by two generally linearly-shaped sides, wherein the pin cross section geometry includes an imaginary pin cross section longitudinal axis and the cavity cross section includes an imaginary cavity cross section longitudinal axis, wherein the imaginary pin cross section longitudinal axis is oriented generally normal to the imaginary cavity cross section longitudinal axis if the cap is in the sealed position, and wherein the imaginary pin cross section longitudinal axis is generally aligned with the imaginary cavity cross section longitudinal axis if the cap is in the open position.

17. A baby bottle for use with a nipple, the baby bottle comprising:

a first container defining a proximate first container opening, a distal first container opening, and a first chamber, wherein proximate first container opening is configured to be closed by the nipple;

a second container defining a proximate second container opening, a distal second container opening, and a second chamber;

a first cap pivotally mounted on the second container and having an open position and a sealing position, wherein the first cap is configured to cover the proximate second container opening when the first cap is in the sealing position;

a second cap configured to enclose the distal second container opening, wherein at least a portion of the second cap is movable between a cap first position and a cap second position; and a rod configured for coupling to the second cap and for extending in a direction toward the proximate second container opening when the second cap encloses the distal second container opening, wherein the rod is further configured to move between a rod first position and a rod second position in response to movement of the at least a portion of the second cap between the cap first position and the cap second position, wherein at least a portion of the second container is configured to be disposed within the first chamber so that the second chamber is in communication with the first chamber via the proximate second container opening when the first cap is in the open position, and wherein the rod, the first cap and the second cap are configured so that the first cap is moved from the closed position to the open position in response to movement of the rod from the rod first position to the rod second position.

18. The baby bottle of claim 17 wherein the second cap is comprised of a rigid member and a flexible wall, wherein the rigid member is configured to engage the first container and wherein the flexible wall is configured for coupling to the rod.

19. The baby bottle of claim 17 wherein the second cap is comprised of a rigid member and a flexible wall, wherein the rigid member is configured to engage the first container, wherein the flexible wall is configured for coupling to the rod, and wherein the at least a portion of the second cap is configured to move from the cap first position to the cap second position in response to an external force applied to the flexible wall in a direction generally normal to the flexible wall.

20. The baby bottle of claim 17 wherein the second cap further comprises a sleeve, and wherein the rod is configured to mate with the sleeve.

21. The baby bottle of claim 17 wherein each of the first container, the second container and the second cap is configured for disassembly and re-assembly during normal usage.

22. The baby bottle of claim 17 wherein the first cap is pivotally mounted on the second container with a hinge, wherein the hinge comprises a pin and a hinge member defining a hinge cavity configured to receive the pin.

23. The baby bottle of claim 22 wherein the pin is secured to inhibit rotation of the pin, wherein the pin has a pin cross section geometry and the hinge cavity has a cavity cross section geometry, wherein the hinge cavity has a cavity wall and is configured to permit relative rotation between the cavity wall and the pin when the first cap moves between the sealing position and the open position, and wherein the pin cross section geometry and the cavity cross section geometry are configured so that one of no stress and a first stress is exerted between the pin and the cavity wall if the first cap is in the open position, and so that a second stress is exerted between the pin and the cavity wall if the first cap is in the sealing position, wherein the second stress is greater than the first stress.

24. A device for holding a first substance and a second substance, the device comprising:

a first container defining a first chamber for containing the first substance;

a second container defining a second chamber for containing the second substance, wherein the first and second containers are configured so that at least a portion of the second container can be inserted into the first container, wherein the second container defines a proximate second container opening leading into the second chamber, and wherein the second chamber is configured to be in communication with the first chamber via the proximate second container opening when the second container is inserted into the first container; and means for alternately closing and opening the proximate second container opening a plurality of times, wherein the first and second chambers are not in communication with one another each time that the second container opening is closed and wherein the first and second chambers are in communication with one another each time that the proximate second container opening is opened.

25. A method of mixing a first substance and a second substance, the method comprising:

providing a first container and a second container, wherein the first container defines a first chamber containing the first substance and the second container defines a second chamber containing the second substance;

actuating an operating member;

moving a first cap from a sealing position to an open position, wherein the first cap is disposed between the first chamber and the second chamber if the first cap is in the sealing position, wherein the first chamber is in communication with the second chamber if the first cap is in the open position, and wherein the first cap is coupled to one of the first container and the second container when the first cap is both in the sealing position and in the open position; and mixing the first substance and the second substance.

26. The method of claim 25 wherein the second container defines a second container opening, wherein actuating the operating member includes pushing a second cap coupled to the operating member and wherein the second cap is configured to enclose the second container opening.

27. The method of claim 25 wherein moving the first cap from the sealing position to the open position includes rotating the first cap from the sealing position to the open position about a hinge, wherein the hinge comprises a pin and a hinge member defining a hinge cavity, and wherein the hinge cavity is configured to receive the pin.

28. The method of claim 25 wherein the first container defines a first container opening, and wherein the second container is configured to mate with the first container in a generally coaxial relationship so that the first container opening is sealed closed.

29. A method of mixing a first substance and a second substance, the method comprising:

inserting at least a portion of a second container into a first container, wherein the second container is configured for use with a first cap and a second cap;

placing the second substance into the second container through a distal second container opening defined by the second container;

enclosing the distal second container opening with the second cap;

placing the first substance into the first container through a proximate first container opening defined by the first container;

enclosing the proximate first container opening; and pushing the second cap thereby actuating an operating member and opening the first cap.

30. The method of claim 29 wherein pushing the second cap includes pushing a flexible wall of the second cap, wherein the flexible wall includes a sleeve and wherein the operating member is a rod, the method further comprising:

inserting the rod into the sleeve.

31. The method of claim 30 wherein each of the first container, the second container and the second cap is configured for disassembly and re-assembly a plurality of times during normal usage.

32. The method of claim 29 wherein the first cap has a sealing position and an open position, and wherein the first cap is pivotally connected to the second container when the first cap is both in the sealing position and in the open position.

33. The method of claim 32 wherein the first cap is pivotally connected to the second container with a hinge, wherein the hinge comprises a pin and a hinge member defining a hinge cavity configured to receive the pin.

34. The method of claim 33 wherein the pin is secured to inhibit rotation of the pin, wherein the pin has a pin cross section geometry and the hinge cavity has a cavity cross section geometry, wherein the hinge cavity has a cavity wall and is configured to permit relative rotation between the cavity wall and the pin when the first cap moves between the sealing position and the open position, and wherein the pin cross section geometry and the cavity cross section geometry are configured so that one of no stress and a first stress is exerted between the pin and the cavity wall if the first cap is in the open position, and so that a second stress is exerted between the pin and the cavity wall if the first cap is in the sealing position, wherein the second stress is greater than the first stress.

* * * * *